US010301706B2

(12) United States Patent
Asano et al.

(10) Patent No.: US 10,301,706 B2
(45) **Date of Patent: *May 28, 2019**

(54) ALUMINUM ALLOY SHEET THAT EXHIBITS EXCELLENT SURFACE QUALITY AFTER ANODIZING AND METHOD FOR PRODUCING THE SAME

(71) Applicants: Mineo Asano, Tokyo (JP); Yusuke Yamamoto, Tokyo (JP)

(72) Inventors: Mineo Asano, Tokyo (JP); Yusuke Yamamoto, Tokyo (JP)

(73) Assignee: SUMITOMO LIGHT METAL INDUSTRIES, LTD., Minato-ku, Tokyo (JP)

( * ) Notice: Subject to any disclaimer, the term of this patent is extended or adjusted under 35 U.S.C. 154(b) by 444 days.

This patent is subject to a terminal disclaimer.

(21) Appl. No.: 13/864,777

(22) Filed: Apr. 17, 2013

(65) Prior Publication Data

US 2013/0280122 A1 Oct. 24, 2013

(30) Foreign Application Priority Data

Apr. 20, 2012 (JP) ..... 2012-096734

(51) Int. Cl.

| | |
|---|---|
| ***C22C 21/08*** | (2006.01) |
| ***C22C 21/00*** | (2006.01) |
| ***C22C 21/06*** | (2006.01) |
| ***B21B 1/26*** | (2006.01) |
| ***C25D 11/04*** | (2006.01) |
| ***C22C 21/14*** | (2006.01) |
| ***C22C 21/16*** | (2006.01) |
| ***C22F 1/047*** | (2006.01) |
| ***C22F 1/057*** | (2006.01) |

(52) U.S. Cl.

CPC ..... *C22C 21/08* (2013.01); *B21B 1/26* (2013.01); *C22C 21/00* (2013.01); *C22C 21/06* (2013.01); *C22C 21/14* (2013.01); *C22C 21/16* (2013.01); *C22F 1/047* (2013.01); *C22F 1/057* (2013.01); *C25D 11/04* (2013.01)

(58) Field of Classification Search

CPC ..... C22C 21/00; C22C 21/06; C22C 21/08

USPC ..... 148/437–440; 420/532

See application file for complete search history.

(56) References Cited

U.S. PATENT DOCUMENTS

2008/0289731 A1* 11/2008 Uesugi et al. ..... 148/692

FOREIGN PATENT DOCUMENTS

JP 09143602 A * 6/1997

OTHER PUBLICATIONS

English language machine translation of JPH09143602 to Moriyama et al. Generated Aug. 17, 2015.*

* cited by examiner

*Primary Examiner* — Brian D Walck

(74) *Attorney, Agent, or Firm* — Flynn Thiel, P.C.

(57) ABSTRACT

An aluminum alloy sheet that exhibits excellent surface quality after anodizing, includes a peritectic element that undergoes a peritectic reaction with at least aluminum, and requires an anodic oxide coating is characterized in that the concentration of the peritectic element in a solid-solution state that is present in the outermost surface area of the aluminum alloy sheet varies in the widthwise direction of the aluminum alloy sheet in the form of a band having a width of 0.05 mm or less, and the difference in the concentration of the peritectic element between adjacent bands is 0.008 mass % or less.

5 Claims, No Drawings

ALUMINUM ALLOY SHEET THAT EXHIBITS EXCELLENT SURFACE QUALITY AFTER ANODIZING AND METHOD FOR PRODUCING THE SAME

BACKGROUND

The invention relates to an aluminum alloy sheet that exhibits an excellent surface quality after anodizing (i.e., does not show a band-like streak pattern after anodizing), and a method for producing the same.

In recent years, an aluminum alloy sheet has been increasingly applied to automotive interior parts and outer panels for consumer electronics. These products are required to exhibit an excellent surface quality, and are often used in an anodized state. However, an outer panel for consumer electronics may show a band-like streak pattern after anodizing, for example. Therefore, an aluminum alloy sheet that does not show a band-like streak pattern after anodizing has been desired.

Various attempts have been made to prevent such a band-like streak pattern, and methods that control the chemical components, the crystal grain size of the final sheet, the dimensions and the distribution density of precipitates, or the like have been proposed. However, a band-like streak pattern may not be prevented by these methods.

JP-A-2000-273563 and JP-A-2006-52436 disclose related-art technology.

SUMMARY OF THE INVENTION

The invention was conceived as a result of finding that the occurrence of a band-like streak pattern after anodizing is affected by an element that undergoes a peritectic reaction with aluminum and is present in a solid-solution state, and conducting tests and studies based on the above finding. An object of the invention is to provide an aluminum alloy sheet that exhibits an excellent surface quality after anodizing (i.e., does not show a band-like streak pattern after anodizing), and a method for producing the same.

A first aspect of the invention provides an aluminum alloy sheet that exhibits an excellent surface quality after anodizing, the aluminum alloy sheet including a peritectic element that undergoes a peritectic reaction with at least aluminum, and requiring an anodic oxide coating, a concentration of the peritectic element in a solid-solution state that is present in an outermost surface area of the aluminum alloy sheet varying in a widthwise direction of the aluminum alloy sheet in a form of a band having a width of 0.05 mm or more, and a difference in the concentration of the peritectic element between adjacent bands being 0.008 mass % or less. Note that the unit "mass %" may be hereinafter referred to as "%".

The aluminum alloy sheet may include either or both of 0.001 to 0.1 mass % of Ti and 0.0001 to 0.4 mass % of Cr as the peritectic element.

The aluminum alloy sheet may include either or both of 0.001 to 0.1 mass % of Ti and 0.0001 to 0.4 mass % of Cr as the peritectic element, and one or more elements among 0.3 to 6.0 mass % of Mg, 0.5 mass % or less of Cu, 0.5 mass % or less of Mn, 0.4 mass % or less of Fe, and 0.3 mass % or less of Si, with the balance being Al and unavoidable impurities.

A second aspect of the invention provides a method for producing the aluminum alloy sheet according to the first aspect of the invention, the method including subjecting an ingot to hot rolling and cold rolling to produce an aluminum alloy sheet, a rolling target side of the ingot having a structure in which a difference in concentration of a peritectic element between an area having a diameter of 5 μm and positioned in a center area of a crystal grain and an area having a diameter of 5 μm and positioned away from a grain boundary of the crystal grain by 2.5 μm is 0.040% or less.

Several aspects of the invention may thus provide an aluminum alloy sheet that exhibits an excellent surface quality after anodizing (i.e., does not show a band-like streak pattern after anodizing), and a method for producing the same.

DESCRIPTION OF EXEMPLARY EMBODIMENTS

When an aluminum alloy sheet that includes a peritectic element that undergoes a peritectic reaction with aluminum is produced by hot rolling and cold rolling using a normal method, the peritectic element in a solid-solution state is present in the surface area of the aluminum alloy sheet as a band that extends in the lengthwise direction (rolling direction) of the aluminum alloy sheet, and the concentration of the peritectic element in a solid-solution state differs depending on each band (i.e., varies in the widthwise direction of the aluminum alloy sheet).

An aluminum alloy sheet according to one embodiment of the invention is characterized in that the concentration of the peritectic element in a solid-solution state that is present in the outermost surface area of the aluminum alloy sheet varies in the widthwise direction of the aluminum alloy sheet in the form of a band having a width of 0.05 to about 5 mm, and the difference in the concentration of the peritectic element between adjacent bands is 0.008% or less. It is possible to obtain an anodized aluminum alloy sheet that exhibits excellent surface quality and is free from a band-like streak pattern by anodizing an aluminum alloy sheet having the above features. If the difference in the concentration of the peritectic element between adjacent bands exceeds 0.008%, a streak pattern may be observed with the naked eye (i.e., excellent surface quality may not be obtained) after anodizing.

The peritectic element is incorporated in an anodic oxide coating in a solid-solution state due to anodizing. When anodizing an aluminum alloy sheet having the above features, the resulting anodized aluminum alloy sheet also has a structure in which the concentration of the peritectic element in a solid-solution state that has been incorporated in the anodic oxide coating varies in the widthwise direction of the aluminum alloy sheet in the form of a band having a width of 0.05 to about 5 mm, and the difference in the concentration of the peritectic element between adjacent bands is 0.005% or less.

The concentration of the peritectic element in a solid-solution state is determined by a linear analysis that measures the concentration of the peritectic element from fluorescent X-rays that are generated by applying electron beams at a pitch of 10 μm using an electron probe microanalyser (EPMA), and the difference in the concentration of the peritectic element between adjacent bands is calculated.

Examples of a preferable peritectic element include Ti and Cr.

Ti is used as an element that suppresses coarsening of the cast structure. The Ti content is preferably 0.001 to 0.1%. If the Ti content is less than 0.001%, coarsening of the cast structure may not be suppressed. If the Ti content exceeds 0.1%, coarse intermetallic compounds may be produced, and a streak pattern due to the intermetallic compounds may be observed after anodizing.

Cr is used as an element that improves the strength of the aluminum alloy sheet, and refines the crystal grains. The Cr content is 0.4% or less to obtain the above effect. However, if the Cr content is less than 0.0001%, the production cost is increased and it becomes difficult to produce the aluminum alloy sheet in a commercial base, because the use of a higher purity aluminum material is required. The Cr content is preferably 0.0001 to 0.4%, and the Cr content is more preferably 0.003 to 0.4%. If the Cr content exceeds 0.4%, coarse intermetallic compounds may be produced, and a streak pattern due to the intermetallic compounds may be observed after anodizing.

The aluminum alloy sheet according to one embodiment of the invention may include one or more elements among the following alloy elements in addition to the peritectic element.

Mg

Mg improves the strength of the aluminum alloy sheet. The Mg content is preferably 0.3 to 6.0%. If the Mg content is less than 0.3%, an improvement in strength may not be achieved. If the Mg content exceeds 6.0%, cracks may occur during hot rolling.

Cu

Cu improves the strength of the aluminum alloy sheet, and ensures that the entire anodic oxide coating has a uniform color tone. The Cu content is preferably 0.5% or less. If the Cu content exceeds 0.5%, Al—Cu precipitates (intermetallic compounds) may be formed, and a streak pattern may occur, or the anodic oxide coating may become turbid due to the intermetallic compounds.

Mn

Mn improves the strength of the aluminum alloy sheet, and refines the crystal grains. The Mn content is preferably 0.5% or less. If the Mn content exceeds 0.5%, Al—Mn—Si crystallized products or precipitates (intermetallic compounds) may be formed, and a streak pattern may occur, or the anodic oxide coating may become turbid due to the intermetallic compounds.

Fe

Fe improves the strength of the aluminum alloy sheet, and refines the crystal grains. The Fe content is preferably 0.4% or less. If the Fe content exceeds 0.4%, Al—Fe—Si or Al—Fe crystallized products or precipitates (intermetallic compounds) may be formed, and a streak pattern may occur, or the anodic oxide coating may become turbid due to the intermetallic compounds.

Si

Si improves the strength of the aluminum alloy sheet, and refines the crystal grains. The Si content is preferably 0.3% or less. If the Si content exceeds 0.3%, Al—Fe—Si crystallized products or Si precipitates (intermetallic compounds) may be formed, and a streak pattern may occur, or the anodic oxide coating may become turbid due to the intermetallic compounds.

As unavoidable impurities, an element such as Zn is inevitably included in the aluminum alloy. For example, Zn not more than 0.25% does not affect the effect of the invention.

Specifically, the embodiments of the invention may be applied to a pure aluminum (1000 series) aluminum alloy, an Al—Mn (3000 series) aluminum alloy, an Al—Mg (5000 series) aluminum alloy, and an Al—Mg—Si (6000 series) aluminum alloy that include a peritectic element such as Ti and Cr.

A method for producing an aluminum alloy sheet according to one embodiment of the invention is described below. The method for producing an aluminum alloy sheet according to one embodiment of the invention includes subjecting an ingot to hot rolling and cold rolling to produce an aluminum alloy sheet, the rolling target side of the ingot having a structure in which the difference in the concentration of a peritectic element between an area having a diameter of 5 μm and positioned in a center area of a crystal grain and an area having a diameter of 5 μm and positioned away from the grain boundary of the crystal grain by 2.5 μm is 0.040% or less. An aluminum alloy sheet produced using such an ingot exhibits an excellent surface quality after anodizing (i.e., does not show a band-like streak pattern after anodizing).

The rolling target side of an ingot that has been cast using a normal semicontinuous casting method, and then homogenized has a cast structure in which the crystal grains formed during casting have an average grain size of 50 to 500 μm. For example, the crystal grains at several points of each (upper and lower) rolling target side of the ingot are subjected to point analysis that measures the concentration of the peritectic element from fluorescent X-rays that are generated by applying electron beams using an EPMA in an area having a diameter of 5 μm and positioned in the center area of a crystal grain and an area having a diameter of 5 μm and positioned away from the grain boundary of the crystal grain by 2.5 μm to determine the difference in the concentration of the peritectic element. When the difference in the concentration of the peritectic element is 0.040% or less, an aluminum alloy sheet that is to be anodized is produced using the ingot.

In order to obtain an ingot which is obtained by casting and homogenizing aluminum alloy molten metal that includes the peritectic element, and of which the rolling target side has a structure in which the difference in the concentration of the peritectic element between an area having a diameter of 5 μm and positioned in the center area of a crystal grain and an area having a diameter of 5 μm and positioned away from the grain boundary of the crystal grain by 2.5 μm is 0.040% or less, it is preferable to homogenize the ingot at a temperature less than the solidus temperature of the aluminum alloy (more preferably at a temperature equal to or higher than "solidus temperature—50° C.") for more than 3 hours.

EXAMPLES

The invention is further described below by way of examples and comparative examples to demonstrate the advantageous effects of the invention. Note that the following examples merely illustrate several embodiments of the invention, and the invention is not limited to the following examples.

Example 1 and Comparative Example 1

An ingot of an aluminum alloy having the composition shown in Table 1 was cast using a DC casting method. The resulting ingot (thickness: 500 mm, width: 1000 mm (transverse cross-sectional dimensions)) was homogenized under the conditions shown in Table 1, and cooled to room temperature. The upper side (rolling target side), the lower side (rolling target side), the right side, and the left side of the ingot were faced by 20 mm. The crystal grains of the rolling target side of the ingot were subjected to point analysis (five points) using an EPMA to determine the distribution state of Ti and Cr in a solid-solution state. The difference in the average value of the total concentration of Ti and Cr in a solid-solution state between an area having a diameter of 5 μm and positioned in the center area of the crystal grain and an area having a diameter of 5 μm and positioned away from the grain boundary of the crystal grain by 2.5 μm was calculated.

The homogenized ingot was heated to 480° C., and hot-rolled to a thickness of 5.0 mm. The hot rolling finish temperature was set to 250° C. The ingot was then cold-rolled to a thickness of 1.0 mm, and softened at 400° C. for 1 hour.

The resulting sheet material was subjected to linear analysis (in an arbitrary five areas having a length of 10 mm in the widthwise direction) using an EPMA to determine the distribution state of Ti and Cr in a solid-solution state to calculate the difference in the average value of the total concentration of Ti and Cr in a solid-solution state between adjacent bands. A plurality of bands were measured by the linear analysis (length: 10 mm), and a plurality of concentration differential values were obtained. The maximum difference in concentration between adjacent bands was taken as a representative value. The average value of the five representative values was calculated.

The sheet material was surface-roughened by shot blasting, chemically polished using phosphoric acid and sulfuric acid, and anodized using sulfuric acid to form an anodic oxide coating having a thickness of 10 μm. The presence or absence of a band-like streak pattern on the anodized sheet was determined with the naked eye. The anodized sheet was subjected to linear analysis (in five areas (streak pattern areas when a streak pattern was observed) having a length of 10 mm in the widthwise direction) using an EPMA to determine the distribution state of Ti and Cr in a solid-solution state. The difference in the average value of the total concentration of Ti and Cr in a solid-solution state between adjacent bands was calculated. A plurality of bands were measured by the linear analysis (length: 10 mm), and a plurality of concentration differential values were obtained. The maximum difference in concentration between adjacent bands was taken as a representative value. The average value of the five representative values was calculated.

The results are shown in Tables 2 and 3. As shown in Table 2, when using the inventive samples 1 to 10, the homogenized ingot had a structure in which the difference in the average value of the total concentration of Ti and Cr in a solid-solution state between the area having a diameter of 5 μm and positioned in the center area of the crystal grain and the area having a diameter of 5 μm and positioned away from the grain boundary of the crystal grain by 2.5 μm was 0.040% or less, and the unanodized sheet material had a structure in which the difference in the average value of the total concentration of Ti and Cr in a solid-solution state between adjacent bands was 0.008% or less.

As shown in Table 3, the samples 1 to 10 exhibited excellent surface quality after anodizing without showing a band-like streak pattern. The anodized sheet material had a structure in which the difference in the average value of the total concentration of Ti and Cr in a solid-solution state between adjacent bands was 0.005% or less.

As shown in Table 2, when using the samples 11 to 15 that were homogenized at a low temperature, the homogenized ingot had a structure in which the difference in the average value of the total concentration of Ti and Cr in a solid-solution state between the area having a diameter of 5 μm and positioned in the center area of the crystal grain and the area having a diameter of 5 μm and positioned away from the grain boundary of the crystal grain by 2.5 μm exceeded 0.040%, and the unanodized sheet material had a structure in which the difference in the average value of the total concentration of Ti and Cr in a solid-solution state between adjacent bands exceeded 0.008%. As shown in Table 3, the anodized sheet material showed a band-like streak pattern after anodizing, and had a structure in which the difference in the average value of the total concentration of Ti and Cr in a solid-solution state between adjacent bands exceeded 0.005%.

TABLE 1

| | Component (mass %) | | | | | | | | |
|---|---|---|---|---|---|---|---|---|---|
| Alloy | Si | Fe | Cu | Mn | Mg | Cr | Zn | Ti | Al |
| A | 0.031 | 0.396 | 0.008 | 0.007 | 2.412 | 0.161 | 0.006 | 0.022 | Bal. |
| B | 0.051 | 0.256 | 0.011 | 0.005 | 5.975 | 0.003 | 0.011 | 0.096 | Bal. |
| C | 0.295 | 0.04 | 0.497 | 0.488 | 0.312 | 0.396 | 0.007 | 0.003 | Bal. |
| D | 0.092 | 0.225 | 0.042 | 0.037 | 1.324 | 0.113 | 0.01 | 0.001 | Bal. |
| E | 0.113 | 0.292 | 0.083 | 0.281 | 2.107 | 0.0001 | 0.005 | 0.042 | Bal. |

TABLE 2

| | | | Total concentration of Ti and Cr in solid-solution state (ingot) (average value of five points) | | Difference in total concentration of Ti and Cr in solid-solution state (ingot) (\|A − B\|) | Total concentration of Ti and Cr in solid-solution state (unanodized sheet) (average value of five points) | | Difference in total concentration of Ti and Cr in solid-solution state (unanodized sheet) (\|C − D\|) |
|---|---|---|---|---|---|---|---|---|
| Sample | Alloy | Homogenization conditions (Temp (° C.)-time (h)) | Area having diameter of 5 μm and positioned in center area of crystal grain (A) | Area positioned away from grain boundary by 2.5 μm (B) | | Total concentration of Ti and Cr in one band (C) | Total concentration of Ti and Cr in adjacent band (D) | |
| 1 | A | 590-5 | 0.199 | 0.164 | 0.035 | 0.188 | 0.180 | 0.008 |
| 2 | B | 540-12 | 0.112 | 0.091 | 0.021 | 0.103 | 0.096 | 0.007 |
| 3 | C | 540-24 | 0.416 | 0.391 | 0.025 | 0.403 | 0.396 | 0.007 |
| 4 | D | 540-12 | 0.128 | 0.099 | 0.029 | 0.118 | 0.111 | 0.007 |
| 5 | E | 540-12 | 0.052 | 0.027 | 0.025 | 0.046 | 0.038 | 0.008 |
| 6 | A | 590-240 | 0.196 | 0.174 | 0.022 | 0.187 | 0.181 | 0.006 |
| 7 | B | 540-480 | 0.108 | 0.093 | 0.015 | 0.102 | 0.097 | 0.005 |
| 8 | C | 540-480 | 0.410 | 0.393 | 0.017 | 0.402 | 0.397 | 0.005 |
| 9 | D | 540-240 | 0.123 | 0.104 | 0.019 | 0.117 | 0.112 | 0.005 |
| 10 | E | 540-240 | 0.047 | 0.031 | 0.016 | 0.044 | 0.039 | 0.005 |
| 11 | A | 500-3 | 0.212 | 0.167 | 0.045 | 0.197 | 0.175 | 0.022 |
| 12 | B | 450-3 | 0.129 | 0.078 | 0.051 | 0.121 | 0.085 | 0.036 |

TABLE 2-continued

| Sample | Alloy | Homogenization conditions (Temp (° C.)-time (h)) | Total concentration of Ti and Cr in solid-solution state (ingot) (average value of five points): Area having diameter of 5 μm and positioned in center area of crystal grain (A) | Total concentration of Ti and Cr in solid-solution state (ingot) (average value of five points): Area positioned away from grain boundary by 2.5 μm (B) | Difference in total concentration of Ti and Cr in solid-solution state (ingot) (\|A − B\|) | Total concentration of Ti and Cr in solid-solution state (unanodized sheet) (average value of five points): Total concentration of Ti and Cr in one band (C) | Total concentration of Ti and Cr in solid-solution state (unanodized sheet) (average value of five points): Total concentration of Ti and Cr in adjacent band (D) | Difference in total concentration of Ti and Cr in solid-solution state (unanodized sheet) (\|C − D\|) |
|---|---|---|---|---|---|---|---|---|
| 13 | C | 480-3 | 0.461 | 0.372 | 0.089 | 0.441 | 0.374 | 0.067 |
| 14 | D | 450-3 | 0.148 | 0.084 | 0.064 | 0.136 | 0.095 | 0.041 |
| 15 | E | 480-3 | 0.065 | 0.021 | 0.044 | 0.056 | 0.026 | 0.030 |

TABLE 3

| Sample | Total concentration of Ti and Cr in solid-solution state (anodized sheet) (average value of five areas): Total concentration of Ti and Cr in one band (E) | Total concentration of Ti and Cr in solid-solution state (anodized sheet) (average value of five areas): Total concentration of Ti and Cr in adjacent band (F) | Difference in total concentration of Ti and Cr in solid-solution state (anodized sheet) (\|E − F\|) | Streak pattern after anodizing |
|---|---|---|---|---|
| 1 | 0.187 | 0.182 | 0.005 | No |
| 2 | 0.101 | 0.097 | 0.004 | No |
| 3 | 0.401 | 0.397 | 0.004 | No |
| 4 | 0.116 | 0.112 | 0.004 | No |
| 5 | 0.044 | 0.040 | 0.004 | No |
| 6 | 0.186 | 0.182 | 0.004 | No |
| 7 | 0.101 | 0.098 | 0.003 | No |
| 8 | 0.401 | 0.398 | 0.003 | No |
| 9 | 0.116 | 0.113 | 0.003 | No |
| 10 | 0.043 | 0.040 | 0.003 | No |
| 11 | 0.191 | 0.178 | 0.013 | Yes |
| 12 | 0.110 | 0.092 | 0.018 | Yes |
| 13 | 0.418 | 0.388 | 0.030 | Yes |
| 14 | 0.128 | 0.106 | 0.022 | Yes |
| 15 | 0.046 | 0.032 | 0.014 | Yes |

Although only some exemplary embodiments and/or examples of the invention have been described in detail above, those skilled in the art will readily appreciate that many modifications are possible in the exemplary embodiments and/or examples without materially departing from the novel teachings and advantages of the invention. Accordingly, all such modifications are intended to be included within the scope of the invention.

The documents described in the specification are incorporated herein by reference in their entirety.

What is claimed is:

1. An aluminum alloy sheet that exhibits a surface quality after anodization in that the occurrence of a band pattern after anodization is prevented, the aluminum alloy sheet comprises at least one of 0.001-0.1 mass % of Ti and 0.0001-0.4 mass % of Cr as a peritectic element that undergoes a peritectic reaction with aluminum, and aluminum, the concentration of the peritectic element in a solid-solution state that is present in an outermost surface area of the aluminum alloy sheet varying in a widthwise direction of the aluminum alloy sheet in a form of a band having a width of at least 0.05 mm and a difference in the concentration of the peritectic element between adjacent bands is no more than 0.008 mass %.

2. The aluminum alloy according to claim 1, wherein Ti is the peritectic element.

3. The aluminum alloy according to claim 1, wherein Cr is the peritectic element.

4. The aluminum alloy according to claim 1, wherein both Ti and Cr are present as peritectic elements.

5. The aluminum alloy sheet according to claim 1, additionally comprising one or more elements among 0.3 to 6.0 mass % of Mg, 0.5 mass % or less of Cu, 0.5 mass % or less of Mn, 0.4 mass % or less of Fe, and 0.3 mass % or less of Si, with the balance being Al and unavoidable impurities.

* * * * *